US011203844B2

(12) United States Patent
Bjorklund

(10) Patent No.: US 11,203,844 B2
(45) Date of Patent: Dec. 21, 2021

(54) SYSTEM AND METHOD FOR DISPENSING ROAD MARKERS AND ATTACHING THE ROAD MARKERS TO A ROAD SURFACE

(71) Applicant: Fortson-Peek Company, Inc., Columbus, GA (US)

(72) Inventor: Mark S. Bjorklund, Midland, GA (US)

(73) Assignee: FORTSON-PEEK COMPANY, INC., Columbus, GA (US)

( * ) Notice: Subject to any disclaimer, the term of this patent is extended or adjusted under 35 U.S.C. 154(b) by 260 days.

(21) Appl. No.: 16/601,021

(22) Filed: Oct. 14, 2019

(65) Prior Publication Data

US 2021/0108380 A1 Apr. 15, 2021

(51) Int. Cl.
*E01C 23/18* (2006.01)

(52) U.S. Cl.
CPC ..... *E01C 23/18* (2013.01)

(58) Field of Classification Search
CPC ..... E01C 23/18; E01C 23/16; E01C 23/163; E01C 23/166; E01C 23/185
See application file for complete search history.

(56) References Cited

U.S. PATENT DOCUMENTS 3,427,933 A 2/1969 Taylor-Myers
3,477,352 A 11/1969 Harding et al.
4,136,991 A * 1/1979 Clark ..... E01F 9/553 404/15
4,193,512 A * 3/1980 Buxton ..... A63F 9/20 198/408
4,322,177 A * 3/1982 Eigenmann ..... E01F 9/518 404/83
4,607,978 A * 8/1986 Eigenmann ..... E01C 23/18 156/523
4,936,485 A 6/1990 Downing
5,054,648 A * 10/1991 Luoma ..... E01F 9/70 221/185
5,853,263 A * 12/1998 Green ..... E01C 23/18 404/94
5,934,822 A 8/1999 Green
8,123,430 B2 2/2012 Bjorklund
2013/0105078 A1* 5/2013 Dawson ..... E01C 23/18 156/297

FOREIGN PATENT DOCUMENTS

AU 639057 B2 1/1991
CN 202551802 U 11/2012

* cited by examiner

*Primary Examiner* — Abigail A Risic
(74) *Attorney, Agent, or Firm* — Thomas | Horstemeyer, LLC

(57) ABSTRACT

A road marker placement system has a frame, a holder mechanically coupled to the frame, a drive system mechanically coupled to the frame, and a rotatable carrier mechanically coupled to the drive system to allow the rotatable carrier to be rotationally driven by the drive system. The rotatable carrier has at least a first pocket formed therein that receives one of the road markers dispensed from an opening of the holder when the rotatable carrier is in a first position. The rotatable carrier is rotated by the drive system from the first position to a second position that is facing the road surface such that the road marker held in the first pocket is forced at least by gravity and by centrifugal force of the rotating rotatable carrier to be ejected from the first pocket onto an adhesive material located on the road surface.

32 Claims, 8 Drawing Sheets

SYSTEM AND METHOD FOR DISPENSING ROAD MARKERS AND ATTACHING THE ROAD MARKERS TO A ROAD SURFACE

TECHNICAL FIELD

The present disclosure is directed to a system and method for dispensing road markers and attaching them to a road surface.

BACKGROUND

Placing Raised Retroreflective Pavement Markers (RPMs) onto roadways is a common practice all over the world to provide a guide to lanes of traffic, particularly in times of nighttime heavy rain when most pavement markings are difficult to see. While most of the markers approved for use in the U.S. are not very expensive to purchase, the cost of installation can more than quadruple the cost of the marker itself. This is because it is commonly installed manually where a person is sometimes dangerously outside of a truck driving up to the location to place the marker, stopping the vehicle, applying the adhesive to the road surface, and then manually placing the marker in the adhesive before proceeding to the next marker location. This procedure has many dangers as the operator is often placed outside the chassis of the vehicle close to the surface of the roadway, many times in live traffic situations where they can be struck by passing traffic.

Some advances have been made where the adhesive is applied in motion via a ribbon gun, but the motion still has to be relatively slow so that the operator has time to place the marker in the adhesive by hand and ensure, if the marker is directional, that it is placed in the intended direction, which is also subject to human error. Typically, the operator pushes down on the marker with some additional force to make sure the marker is securely set in the adhesive.

There have been numerous attempts to automate this placement process, but for a variety of reasons, e.g., unreliability, cost, over-complication, or lack of efficiency, they have not been commercially adopted. Additional hurdles are encountered with variations in roadway application environment, variations in speed, hills, heat, moisture, etc., and when the markers that are approved for use by the governing authorities are of different sizes or shapes. Some markers are square, some have rounded sides, or indentions to make them easier to grab. Many markers are directional, and require the marker to be placed perpendicular to the direction of travel as well as being in the proper direction, such as in cases where the marker only has a one-way reflector, or a red lens on one side to indicate wrong-way direction.

A need exists for a system and method for automatically placing road markers that overcome the aforementioned disadvantages.

BRIEF DESCRIPTION OF THE DRAWINGS

The example embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

Figure 1:
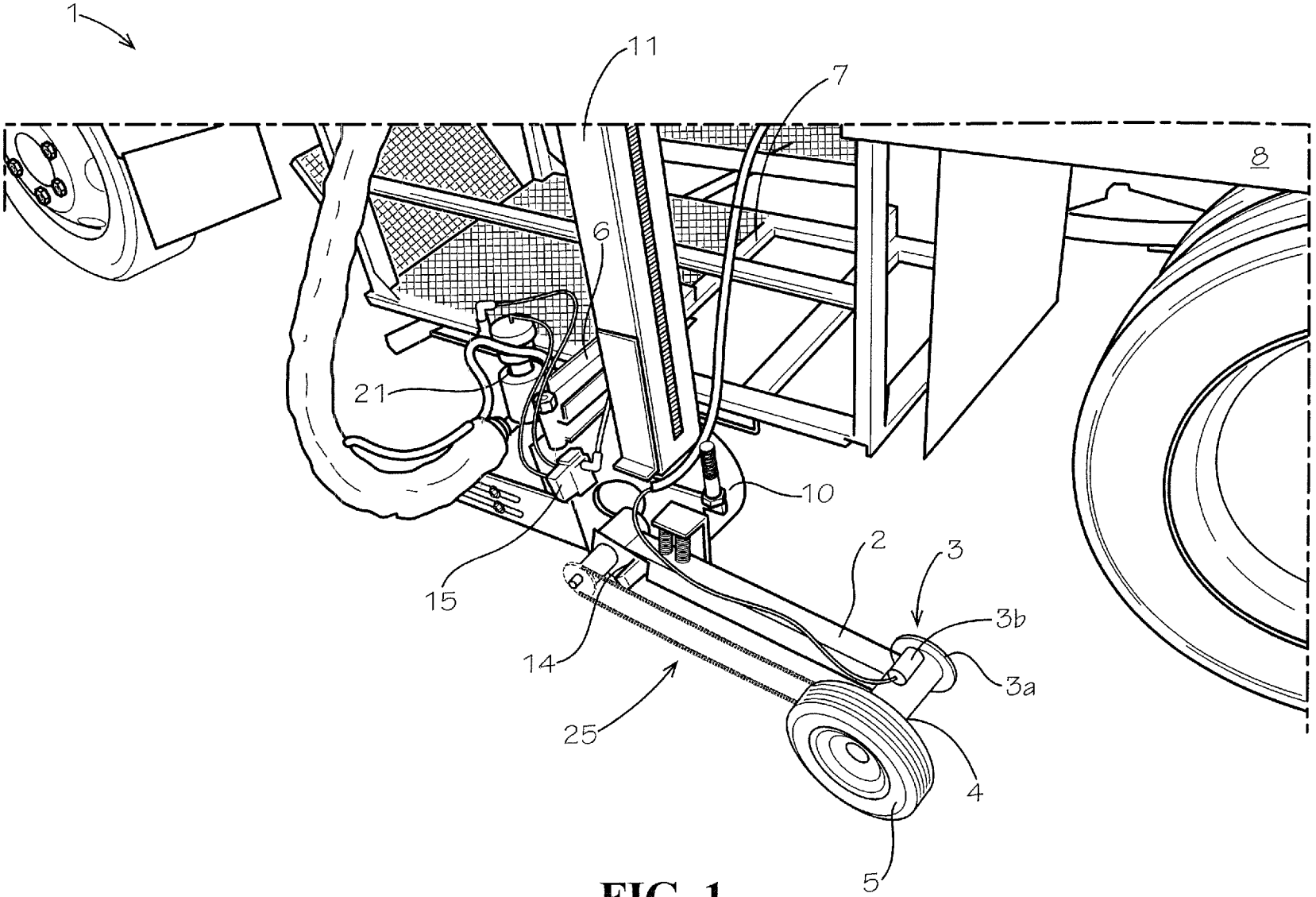
FIG. 1 is a left-side perspective view of a portion of the road marker placement system in accordance with a representative embodiment.

The present disclosure discloses a road marker placement system and method for dispensing road markers and attaching the road markers to a road surface. In accordance with a representative embodiment, the road marker placement system comprises a frame that is adapted to be attached to, or that is integrally formed with, an application vehicle, a holder mechanically coupled to the frame and adapted to hold a plurality of road markers, a drive system mechanically coupled to the frame, and a rotatable carrier mechanically coupled to the drive system to allow the rotatable carrier to be rotationally driven by the drive system. The holder has at least first and second openings for, respectively, loading road markers into and dispensing road markers from the holder. The rotatable carrier has at least a first pocket formed therein that receives one of the road markers dispensed from the second opening of the holder when the rotatable carrier is in a first position in which the first pocket is aligned with the second opening. The rotatable carrier is rotated by the drive system in a first direction from the first position to a second position that is facing the road surface such that the road marker held in the first pocket is forced at least by gravity and by centrifugal force of the rotating rotatable carrier to be ejected from the first pocket onto an adhesive material located on the road surface. After the road marker is ejected from the first pocket, the drive system rotates the rotatable carrier in the first direction from the second position back to the first position where another of the road markers is dispensed from the second opening of the holder into the first pocket. The process is then repeated until the desired number of road markers have been placed on the road surface.

Newton's first law dictates that an object at rest remains at rest, or an object in motion continues to move at that velocity unless acted upon by a force. This law also applies to rotational motion, much like a knuckleball does not rotate, while a curveball spins very fast. Both continue to do so well after they leave a baseball pitcher's hand. Assuming the X-, Y- and Z-directions of a Cartesian coordinate system correspond, respectively, to the direction of travel along a road of an application vehicle that pulls the road marker placement system, the direction perpendicular to the direction of travel and the direction normal to the road surface, if a pavement marker is thrown much like a knuckleball with no rotational spin in a rearward direction at the same velocity as the application vehicle is traveling in the forward direction (X-direction), and the application vehicle is driving straight so that the velocity with respect to the Y-direction is zero, the velocity of the road marker ejected from the rotatable carrier with respect to the roadway would be considered to be zero or at rest, and its exact location on the surface of the roadway would be known. If that known location was over the center of an adhesive material and was applied with a downward force (Z-direction) towards the road surface, it would not only reduce the amount of time it takes for the road marker to land on the adhesive material pad, but it would also help secure the marker firmly in the adhesive, without slowing down or stopping the forward motion of the application vehicle. These and other principles and concepts are applied by the road marker placement system and method disclosed herein to overcome aforementioned shortcomings of the prior approaches to automating the road marker placement process.

In essence, the drive system that drives the rotatable carrier when the engaging mechanism engages the drive system with the rotatable carrier is linked with the frame such that the forward speed of the frame is translated to the rotatable carrier. This, in turn, ensures that the rotatable carrier is rotated at the same speed as the forward speed of the frame, which ensures that the velocity of the road marker ejected from the rotatable carrier is zero or near zero relative to the road surface. This, in turn, ensures that the placement of the road marker on the adhesive material is accomplished with high precision.

The terminology used herein is for purposes of describing particular embodiments only, and is not intended to be limiting. The defined terms are in addition to the technical, scientific, or ordinary meanings of the defined terms as commonly understood and accepted in the relevant context.

The terms "a," "an" and "the" include both singular and plural referents, unless the context clearly dictates otherwise. Thus, for example, "a device" includes one device and plural devices. The terms "substantial" or "substantially" mean to within acceptable limits or degrees acceptable to those of skill in the art. For example, the term "substantially parallel to" means that a structure or device may not be made perfectly parallel to some other structure or device due to tolerances or imperfections in the process by which the structures or devices are made. The term "approximately" means to within an acceptable limit or amount to one of ordinary skill in the art. Relative terms, such as "over," "above," "below," "top," "bottom," "upper" and "lower" may be used to describe the various elements' relationships to one another, as illustrated in the accompanying drawings. These relative terms are intended to encompass different orientations of the device and/or elements in addition to the orientation depicted in the drawings. For example, if the device were inverted with respect to the view in the drawings, an element described as "above" another element, for example, would now be below that element.

Relative terms may be used to describe the various elements' relationships to one another, as illustrated in the accompanying drawings. These relative terms are intended to encompass different orientations of the device and/or elements in addition to the orientation depicted in the drawings.

Figure 2:
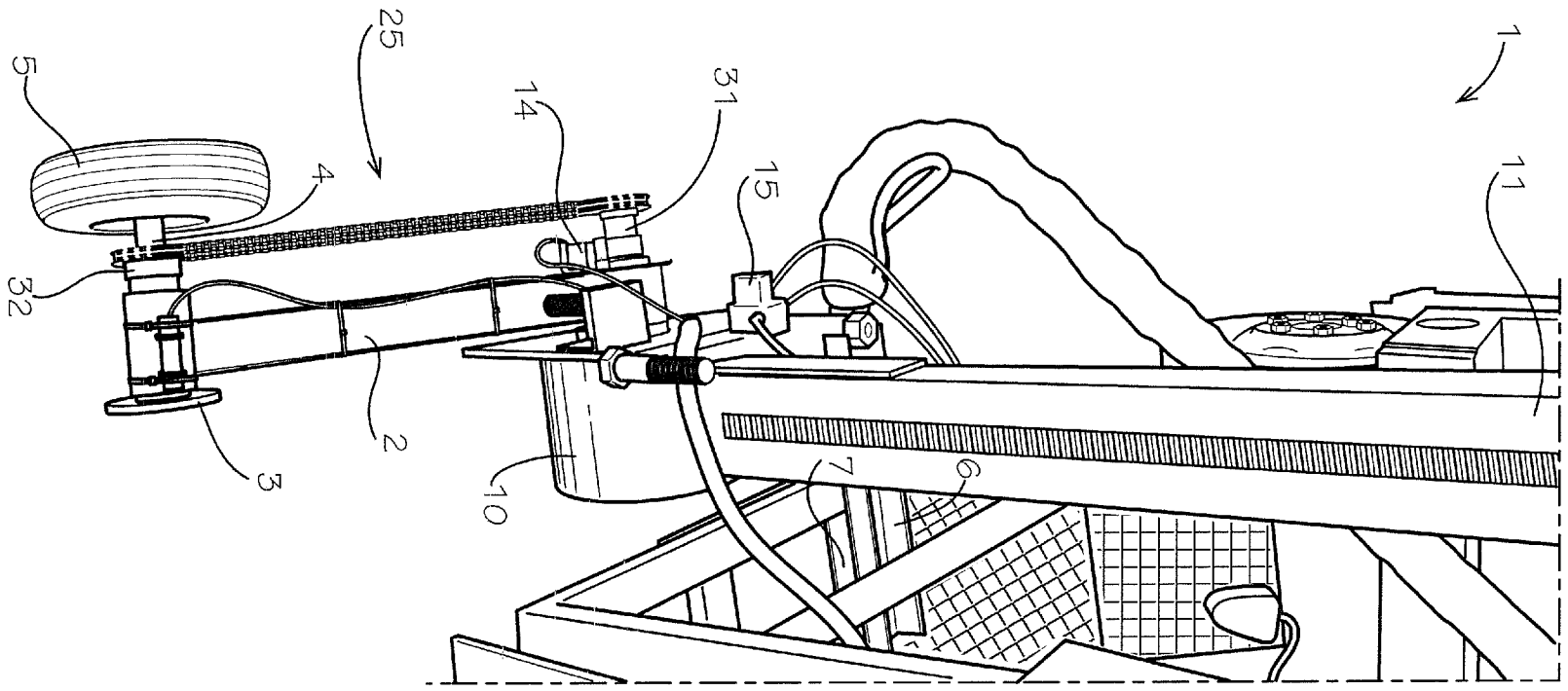
FIG. 2 is a rear perspective view of a portion of the road marker placement system shown in FIG. 1.
Figure 3:
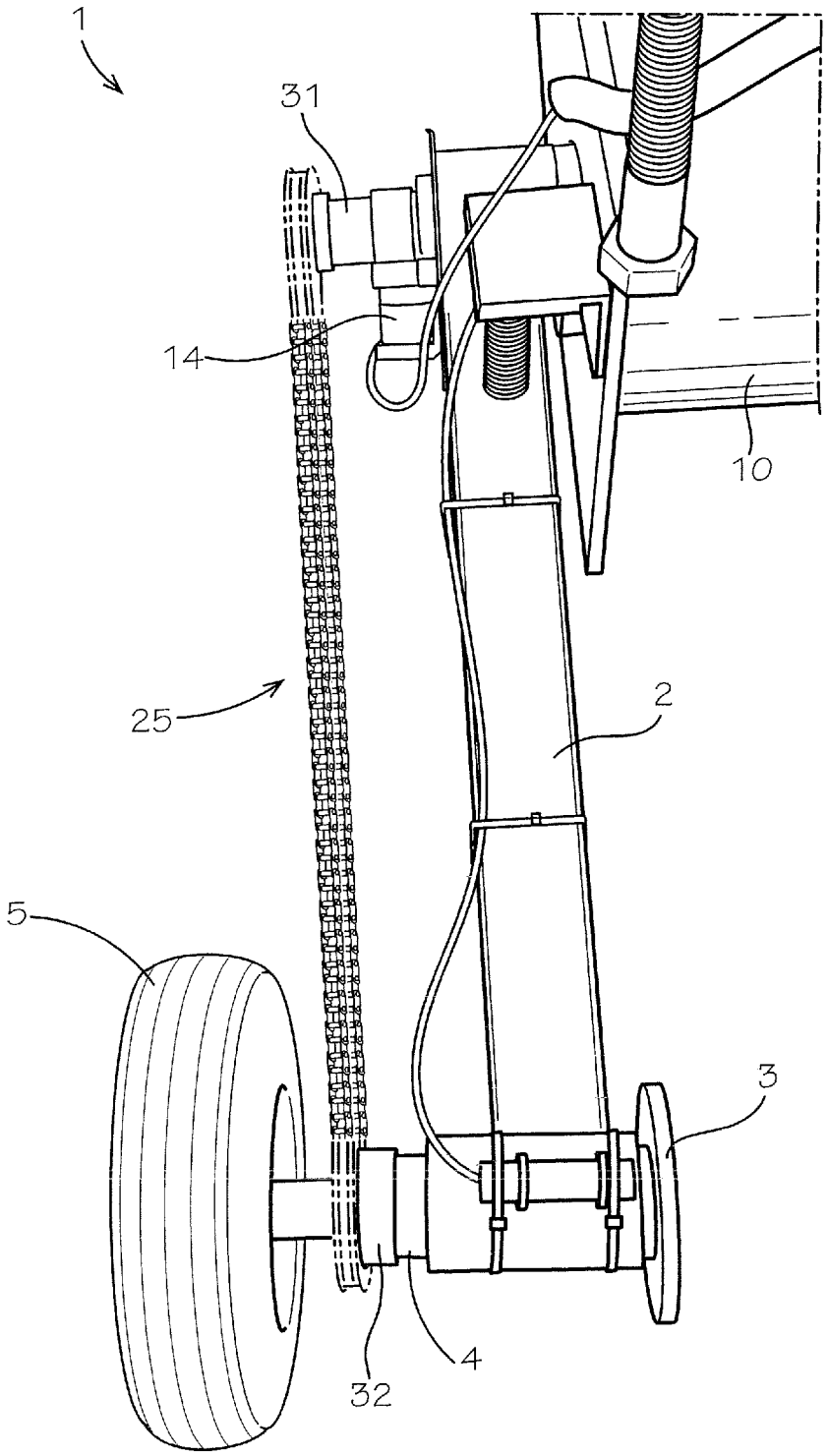
FIG. 3 is a top perspective view of a portion of the road marker placement system shown in FIG. 1.
Figure 4:
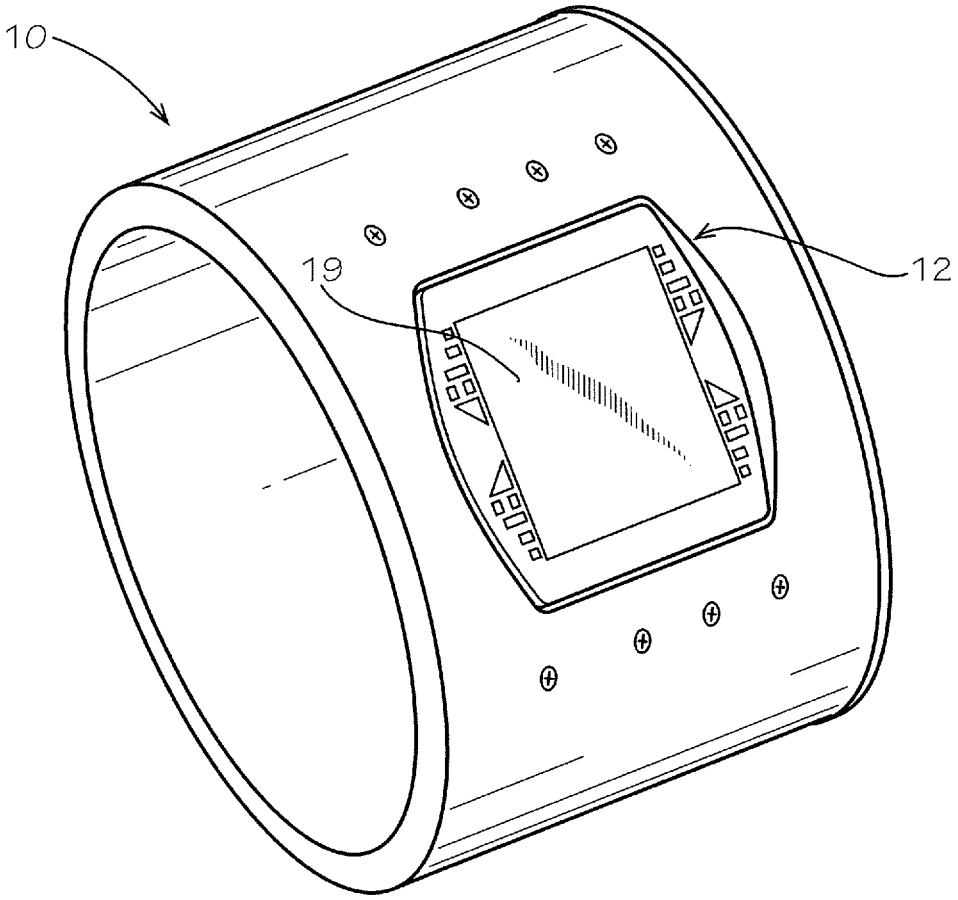
FIG. 4 is a top perspective view of a rotatable carrier of the road marker placement system shown in FIGS. 1-3 with a road marker seated in a first pocket of a rotatable carrier of the system.
Figure 5:
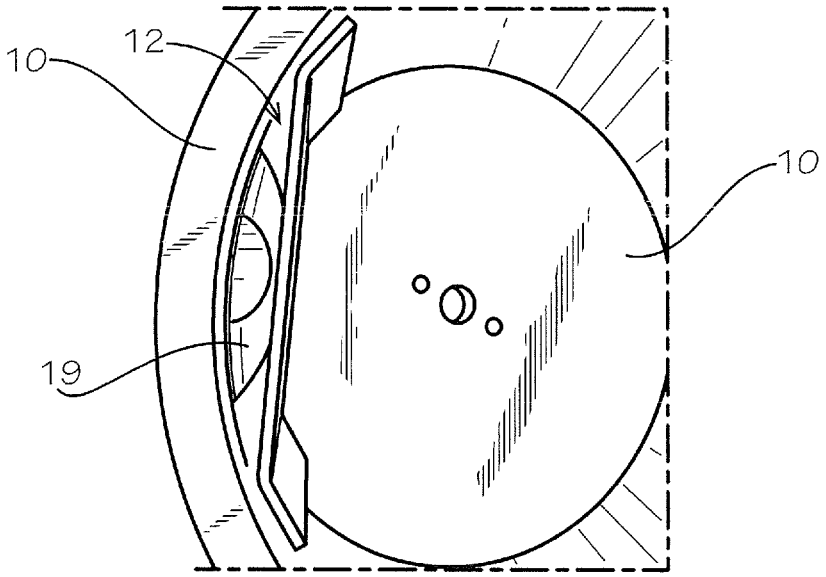
FIG. 5 is a side perspective view of the rotatable carrier shown in FIG. 4.

FIG. 1 is a left-side perspective view of a portion of the road marker placement system 1 in accordance with a representative embodiment. FIG. 2 is a rear perspective view of a portion of the road marker placement system 1 shown in FIG. 1. FIG. 3 is a top perspective view of a portion of the road marker placement system 1 shown in FIG. 1. FIG. 4 is a top perspective view of a rotatable carrier 10 of the road marker placement system 1 shown in FIGS. 1-3 with a road marker 19 seated in a first pocket. FIG. 5 is a side perspective view of the rotatable carrier 10 shown in FIG. 4.

In accordance with this representative embodiment, the components of the system 1 are mounted on, or mechanically coupled to, a frame 2 of the system 1. A distance measurement system 3 of the system 1 is mechanically coupled to an axle 4 of the frame 2. A wheel 5 of the frame 2 is mechanically coupled to the axle 4. An attachment mechanism 6 of the system 1 is secured to the frame 2 and is used to mechanically couple the frame 2 with a part 7 of an application vehicle 8 that pulls the system 1. The inventive principles and concepts are not limited with regard to the manner in which the frame 2 is coupled with the application vehicle or with regard to the type of vehicle that is used as the application. It should also be noted that the frame 2 could be the frame of an application vehicle such that system 1 is an integral part of the application vehicle. Thus, the frame 2 could be the frame of the application vehicle or it could be a frame that is integrally formed as part of the frame of the application vehicle. In the latter scenario, the need for a separate attachment mechanism 6 for coupling the frame 2 with an application vehicle is obviated.

A holder 11 of the system 1 holds a stack of road markers (not shown) in an upside-down orientation so that the road markers are ejected from the rotatable carrier 10 in a right-side up orientation and therefore attach to the road in the right-side up orientation. The holder 11 may be permanently or removably secured to the frame 2. The holder 11 has a first opening (not shown) for loading road markers into the holder 11 and a second opening located at an end of the holder 11 that is in contact with, or spaced a short distance away from, the rotatable carrier 10 from which the road markers are dispensed from the holder 11 onto the rotatable carrier 10. The holder 11 can have virtually any shape and size and can be implemented as, for example, a flexible or rigid tube, chute, hopper, cartridge, or any other device capable of holding and dispensing the road markers that are to be placed by the system 1 on the road surface. Preferably the holder 11 has interior surfaces that are substantially complementary in shape and/or size to outer edges of the road marker to be placed such that a stack of aligned road markers are held in the holder 11. Although the holder 11 may have any shape or configuration, in some embodiments it may be curved such that the first end of the holder 11 is disposed near a bed of the application vehicle 8 to allow an operator or machine to load and reload road markers into the first opening of the holder 11 from the bed of the application vehicle 8.

With reference to FIG. 4, the rotatable carrier 10 has at least a first pocket 12 formed therein that is substantially complementary in shape and size to, but slightly larger than, the road marker 19 held in the holder 11 to allow the road markers to easily seat in the first pocket 12 upside down as they are dispensed from the second opening of the holder 11. In accordance with this representative embodiment, the rotatable carrier 10 is a cylindrical drum, but the rotatable carrier 10 can have other shapes, sizes and configurations. The rotatable carrier 10 needs to comprise an endless loop of some sort so that it can be rotated from a first position at which a road marker is loaded into the first pocket 12 of the rotatable carrier 10, to a second position at which the road marker is ejected from the first pocket 12 of the rotatable carrier onto the road surface, and back to the first position at which the next road marker held at the lowest position in the holder 11 is loaded into the first pocket 12. Other carriers, such as a conveyor belt, for example, could be used for this purpose.

In accordance with a representative embodiment, the holder 11 is fixedly or removably secured to the frame 2 in such a way that the second opening of the holder 11 is positioned a preselected distance above the first pocket 12 when the rotatable carrier 10 is in the first position that ensures that, when the rotatable carrier 10 is in the first position, the road marker at the lowest position in the holder 11 will be dispensed from the holder 11 due to the force of gravity and due to centrifugal force of the rotating rotatable carrier 10 and seat itself in the first pocket 12 without any need for operator intervention. It should be noted that the holder 11 could have more complex configurations, such as, for example, a configuration that uses a spring-loaded mechanism to eject road markers from the second opening into the first pocket 12.

The preselected distance between the second opening of the holder 11 and the rotatable carrier 10 ensures that, when the rotatable carrier 10 is in a position other than the first position, the road marker positioned at the lowest position in the holder 11 is partially within the second opening of the holder 11 and the top surface of the road marker is in abutment with the outer surface of the rotatable carrier 10. Thus, the preselected distance is typically less than the full height of the road marker. Once a road marker is seated in the first position, there is insufficient space between the bottom surface of the road marker seated in the first pocket 12 and the next road marker held at the lowest position in the holder 11 to allow the next road marker to pass out of the second opening of the holder 11. Thus, the next road marker remains stacked on top of the road marker that is seated in the first pocket 12 until the rotatable carrier 10 rotates away from the first position, at which point in time the next road marker held at the lowest position in the holder 11 comes into abutment with the outer surface of the rotatable carrier 10.

Once a road marker is seated in the first pocket 12 and the rotatable carrier 10 has rotated in the first direction (in the direction of travel of the application vehicle) beyond the second opening of the holder 11, the next road marker held at the lowest position of the holder 11 will pass partially out of the second opening and will come into contact with the outer surface of the rotatable carrier 10. Because the next road marker is still partially within the second opening of the holder 11, the contact between that road marker and the holder 11 will prevent the forward motion of the rotatable carrier 10 from carrying that road marker beyond the first position. This, in turn, ensures that the next road marker is properly positioned and oriented at the first position to allow it to load into the first pocket 12 when the rotatable carrier 10 returns to the first position and the empty first pocket 12 re-aligns with the second opening of the holder 11.

Figure 6:
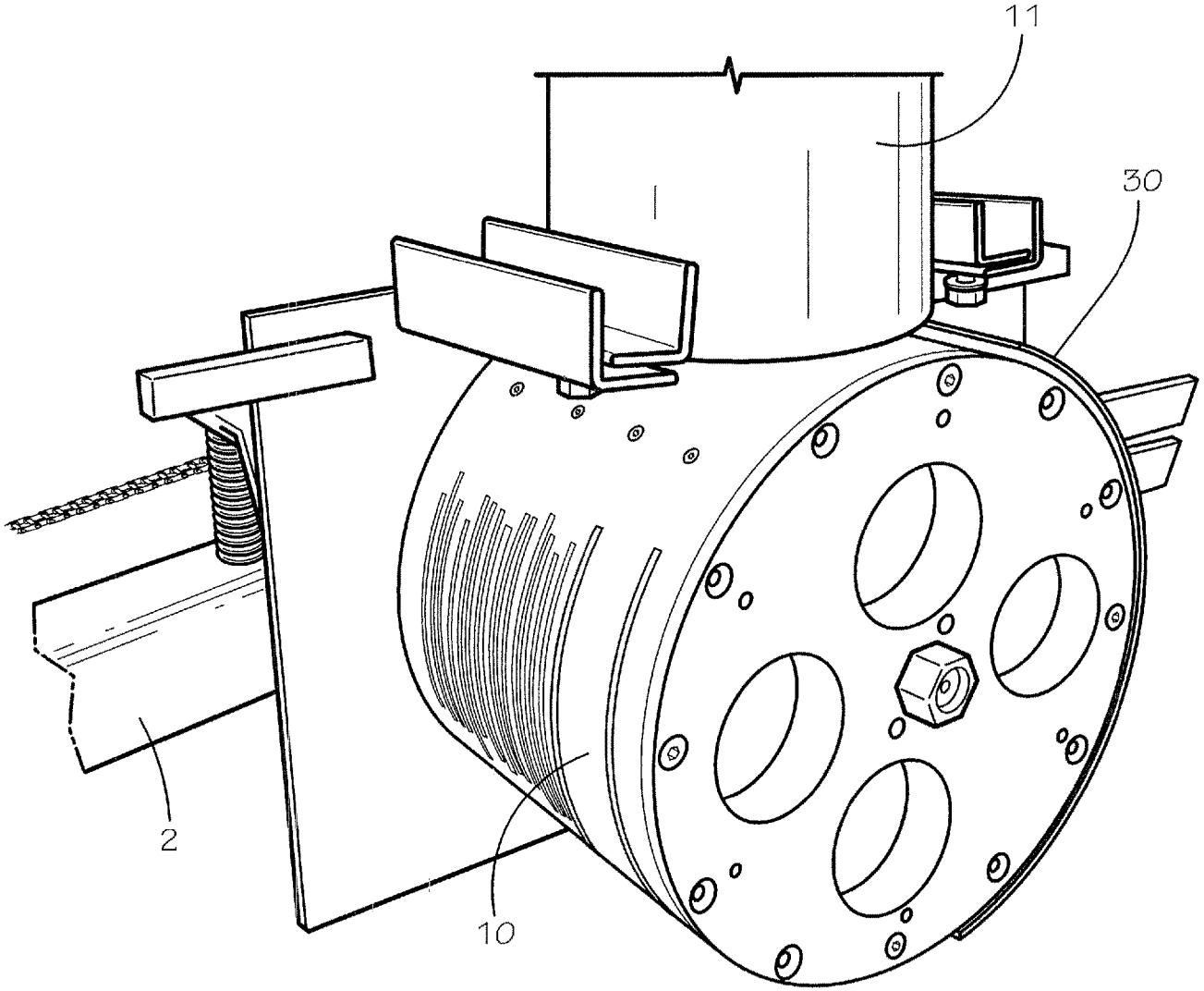
FIG. 6 is a front perspective view of the rotatable carrier attached to the frame and shows the positioning of the holder relative to the rotatable carrier.

FIG. 6 is a front perspective view of the rotatable carrier 10 attached to the frame 2 and shows the positioning of the holder 11 relative to the rotatable carrier 10. In accordance with this representative embodiment, the coupling of the holder 11 to the frame 2 is adjustable to allow the distance between the end of the holder 11 and the rotatable carrier 10 to be adjusted in the vertical direction to accommodate different types of road markers. For example, road marks that are thicker may need the distance between the end of the holder 11 and the surface of the rotatable carrier 10 to be greater compared to cases where the road markers are thinner. This distance preferably is preselected to ensure that when the road marker is seated in the first pocket 12, the seated road marker will clear the holder 11 when the rotatable carrier is rotated in the forward direction away from the first position toward the second position, and to ensure that when the next road marker is partially within the opening of the holder 11 and in abutment with the outer surface of the rotatable carrier 10 before the first pocket 12 has re-aligned with the second opening of the holder 11, the road marker will remain in the second opening of the holder 11 until the first pocket 12 has re-aligned with the second opening. At that point in time, the road marker passes out of the holder 11 and is seated in the first pocket 12.

In accordance with this representative embodiment, a shield 30 is mechanically coupled to the frame 2 and has an inner surface that is spaced apart from the outer surface of the rotatable carrier 10 by a gap having a preselected gap width. The inner surface of the shield 30 has a shape that is substantially complementary to the shape of the outer surface of the rotatable carrier 10. The shield 30 extends approximately from the forward edge of the first position to the rearward edge of the second position, where "forward" refers to the direction of travel of the rotatable carrier when rotating from the first position to the second position during the placement process. The preselected gap width is wide enough to allow a road marker seated in the first pocket 12 to pass underneath the inner surface of the shield 30, but narrow enough to prevent the road marker from falling out of the first pocket 12 as the rotatable carrier 10 rotates from the first position to the second position at which the road marker is ejected from the first pocket 12. Preferably the mechanical coupling of the shield 30 with the frame 2 is adjustable to allow the preselected gap width to be adjusted to accommodate different types of road markers.

In accordance with the representative embodiment of FIGS. 1-3, the system 1 comprises a drive system 25 that is mechanically coupled via an engaging mechanism 14 to the rotatable carrier 10 to allow the rotatable carrier 10 to be rotationally driven by the drive system 25. The drive system 25 is mechanically coupled with the axle 4 of the frame 2 and drives the rotatable carrier 10 when the engaging mechanism 14 engages the drive system 25 with the rotatable carrier 10. During this engagement, the forward speed of the frame 2 is translated to the rotatable carrier 10. This, in turn, ensures that the rotatable carrier 10 is rotated at or near the same forward speed as the frame 2, which ensures that the velocity of the road marker ejected from the rotatable carrier is zero or near zero relative to the road surface This, in turn, ensures that the placement of the road marker on the adhesive material is accomplished with high precision.

In accordance with the representative embodiment shown in FIGS. 1-3, the system 1 includes a timing system (not shown) that controls the engaging mechanism 14 and a solenoid 15 of an adhesive dispensing system 21 (FIG. 1) based on a first distance signal received in the timing system from the distance measurement system 3. As the wheel 5 turns, the distance measurement system 3 measures the distance that the frame 2 travels. The distance measurement system 3 can be a known system that includes magnets that are spaced apart and that rotate as the axle 4 rotates. A sensor of the distance measurement device 3 detects these magnets as the axle 4 rotates and determines the distance traveled by the frame 2. These distance measurement signals are delivered to the timing system. Based on these signals received by the timing system from the distance measurement system 3, the timing system determines when the system 1 has traveled a predetermined distance. In accordance with an embodiment in which the adhesive material is put down as a continuous strip, when the timing system determines that the system 1 has traveled the preselected distance, the timing system sends an engagement signal to the engaging mechanism 14 to cause it to engage the drive system 25 with the rotatable carrier 10. This causes the rotatable carrier 10 to rotate from the first position to the second position as the wheel 5 rotates and to eject the road marker seated in the first pocket 12 from the first pocket 12 (FIGS. 4 and 5) onto the adhesive material strip at the second position.

In accordance with an embodiment in which the adhesive material is dispensed at preselected intervals to form adhesive material at preselected locations on which the road markers will subsequently be placed, the timing system uses the distance measurement signals received from the distance measurement system 3 to determine when to activate the adhesive dispensing system 21 (FIG. 1). In accordance with this embodiment, the timing system sends an adhesive dispensing signal to the adhesive dispensing system 21 when the timing system receives the first distance measurement signal from the distance measurement system 3 to cause the adhesive dispensing system 21 to dispense adhesive material onto the road surface to form the adhesive material at a preselected location on the road surface. The adhesive dispensing system 21 includes a solenoid switch 15 that receives the adhesive dispensing signal and activates an adhesive material dispensing gun of the system 21 to cause it to dispense the adhesive material. In accordance with this embodiment, the timing system delays sending the engagement signal to the engaging mechanism 14 by a predetermined time delay after sending the adhesive dispensing signal to the adhesive dispensing system 21. The predetermined time delay is chosen to ensure that the road marker lands in the adhesive material. The adhesive dispensing system 21 may be a known adhesive dispensing system of the type currently used to apply adhesive material to road surfaces for the purpose of attaching road markers. The timing system may also be a known timing system. Preferably, the timing system can be adjusted to adjust the length of the predetermined time delay.

With reference again to FIG. 1, in accordance with a representative embodiment, the distance measurement system 3 has a disk portion 3*a* that rotates with the axle 4 and a fixed sensor portion 3*b* that is on a portion of the frame 2 that does not rotate. The disk portion 3*a* has a plurality of magnets equally spaced apart about the periphery of the disk portion 3*a*. As the disk portion 3*a* rotates with the axle 4, the sensor portion 3*b* senses the magnets as the pass by it and sends electrical pulses to the timing system, which counts the number of pulses it receives. These electrical pulses are referred to herein as the distance measurement signal. The timing system is calibrated to relate the count to distance and to determine when the count corresponds to a predetermined distance, which triggers the timing system to send the adhesive dispensing signal to the adhesive dispensing system 21 and, after the predetermined delay, to send the engagement signal to the engaging mechanism 14.

Figure 7:
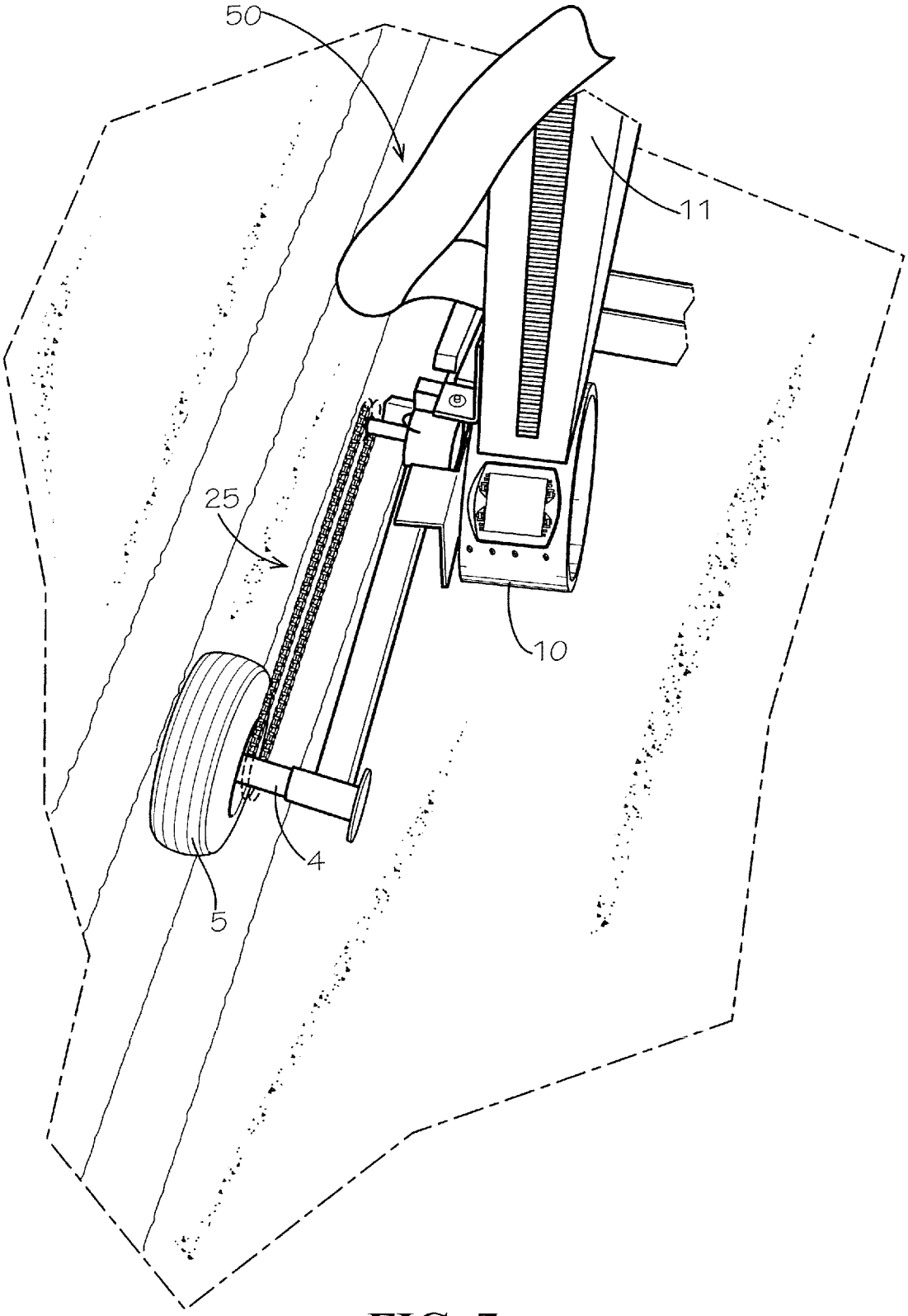
FIG. 7 is a top perspective view of the road marker placement system in accordance with another representative embodiment.

FIG. 7 is a top perspective view of the road marker placement system 50 in accordance with another representative embodiment. In accordance with this embodiment, the system 50 does not include the timing system, the engaging mechanism 14 or the distance measurement system 3. In accordance with this embodiment, the adhesive material can be put down as a continuous strip of adhesive material. In accordance with this embodiment, the drive system 25 is always engaged with the rotatable carrier 10 such that the rolling action of the frame 2 is continuously translated into rotating motion of the rotatable carrier 10. In accordance with this embodiment, the rotatable carrier 10 continuously rotates as the axle 4 rotates. Thus, the distance between locations at which the road markers are placed on the road surface are spaced apart by the same preselected distance. This preselected distance can be set by the choosing the radius of the rotatable carrier 10 and/or by choosing gear ratios of gears of the drive system 25. In accordance with an embodiment, the drive system 25 comprises a sprocket-to-chain or sprocket-to-belt drive, although other drive systems may be used for this purpose. For example, hydraulic drives and electric drives may also be used for this purpose. Therefore, the inventive principles and concepts are not limited with regard to the configuration that is used for the drive system, as will be understood by those of skill in the art in view of the description provided herein.

It should be noted that although the systems 1 and 50 shown in FIGS. 1 and 7, respectively, show a single pocket 12 formed in the rotatable carrier 10, the rotatable carrier 10 can have N pockets formed therein, where N is a positive integer that is greater than or equal to one. For example, for the case where N=3, three pockets that are evenly spaced apart by 120° are formed in the rotatable carrier 10, each pocket receiving a road marker when the respective pocket aligns with the second opening of the holder 11 and ejecting the road marker onto the road surface when the rotatable carrier is rotated by 180° from the aligned position with the second opening of the holder 11. The term "road marker," as that term is used herein, should be construed as any type of device that is capable of being dispensed by the systems 1 and 50 onto a road surface.

Figure 9:
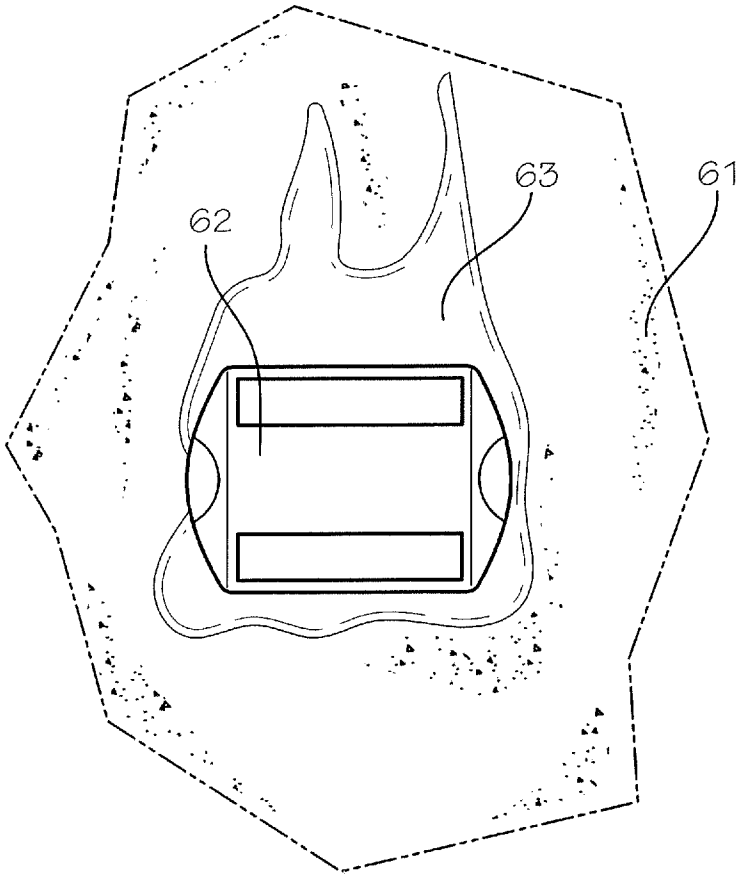
FIG. 9 shows a top view of one of the road markers shown in FIG. 8 disposed on adhesive material that secures the road marker to the road surface.
Figure 8:
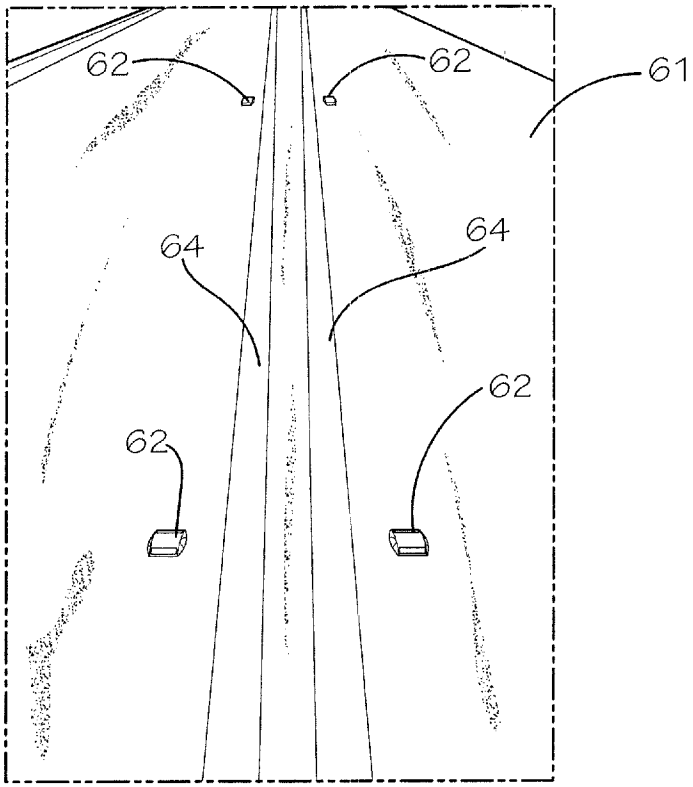
FIG. 8 is a pictorial illustration of a road surface having road markers placed at predetermined locations on the road surface on the left and right sides of the lines by the systems shown in FIG. 1 or 7.

FIG. 8 is a pictorial illustration of a road surface 61 having road markers 62 placed at predetermined locations on the road surface on the left and right sides of the lines 64. In the illustration shown in FIG. 8, pairs of road markers 62 are disposed on the road surface 61. FIG. 9 shows a top view of one of the road markers 62 disposed on adhesive material 63, which secures the road marker to the road surface 61. The road markers 62 were placed using the system 1 shown in FIGS. 1-3. It should be noted that the road markers 62 shown in FIG. 8 may be placed during a single placement operation if two sets of the holders 11 and rotatable carriers 10 are implemented in the system 1. In such cases, a single timing system, drive system 24, and frame 2 may be used in the system 1 for controlling the rotatable carriers 10. Alternatively, two separate placement operations may be performed to put down the road markers 62 on the left and right sides of the lines 64.

It should be noted that the lines, or road markings, 64 could themselves be the adhesive material onto which the road markers 62 are dispensed. In some cases, the road markings 64 make good adhesives, such as when they comprise thermoplastic or epoxy, for example. In such cases, the systems 1 or 50 shown in FIGS. 1 and 7, respectively, may be placed on or connected to the road striping truck and the road markers 62 could be dispensed onto the uncured (typically yellow or white) adhesive strip 64 by the road striping crew, thus obviating the need to send out a separate crew to place the road markers 62.

Figure 10:
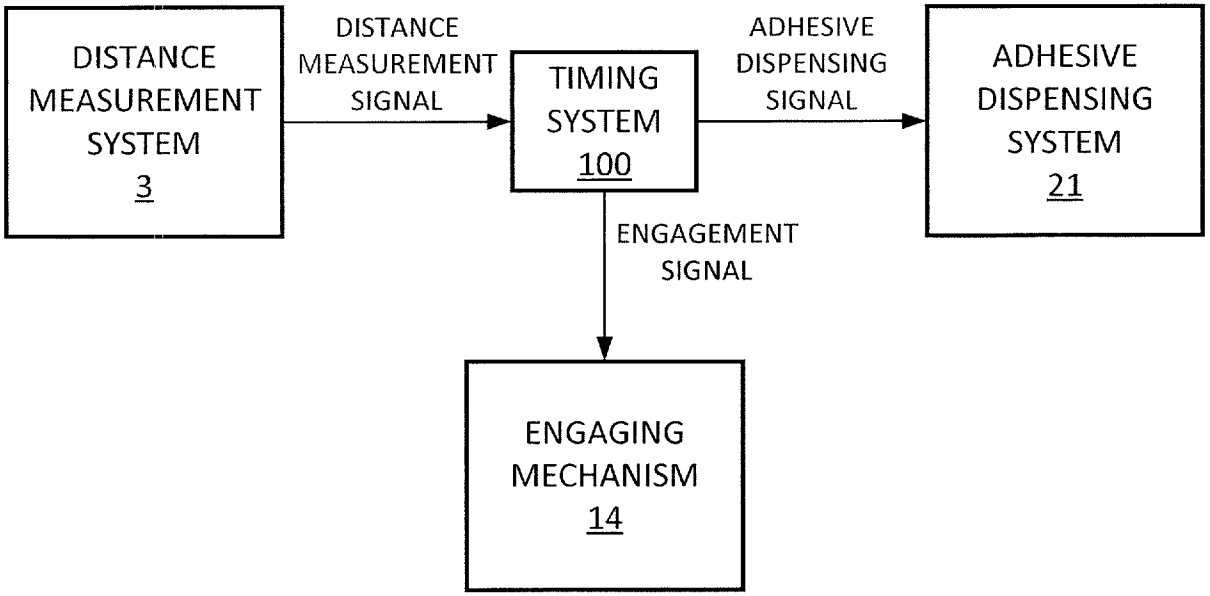
FIG. 10 is a block diagram showing the relationship among the timing system, the engaging mechanism, the distance measurement system and the adhesive dispensing system of the road marker placement system shown in FIGS. 1-3.

FIG. 10 is a block diagram showing the relationship among the timing system 100, the engaging mechanism 14, the distance measurement system 3 and the adhesive dispensing system 21. The timing system 100 controls a solenoid switch (not shown) of the engaging mechanism 14 and the solenoid switch 15 (FIG. 1) of the adhesive dispensing system 21 (FIG. 1) based on a first distance signal received in the timing system 100 from the distance measurement system 3. As the wheel 5 turns, the distance measurement system 3 measures the distance that the frame 2 travels and delivers the corresponding distance measurement signals to the timing system 100. Based on these signals received by the timing system 100 from the distance measurement system 3, the timing system 100 determines when the system 1 (FIG. 1) has traveled a predetermined distance.

In accordance with an embodiment in which the adhesive material is put down as a continuous strip, when the timing system 100 determines that the system 1 has traveled the preselected distance, the timing system 100 sends an engagement signal to the engaging mechanism 14 to cause it to engage the drive system 25 (FIG. 1) with the rotatable carrier 10. This causes the rotatable carrier 10 to rotate from the first position to the second position as the wheel 5 rotates and to eject the road marker seated in the first pocket 12 from the first pocket 12 (FIGS. 4 and 5) onto the adhesive material strip when the rotatable carrier 10 arrives at the second position. Because the adhesive material is put down in a continuous strip, the timing system 100 does not need to output an adhesive dispensing signal to the adhesive dispensing system 21.

In accordance with another embodiment in which the adhesive material is dispensed at preselected intervals to form adhesive material at preselected locations on which the road markers will subsequently be placed, the timing system 100 uses the distance measurement signals received from the distance measurement system 3 to determine when to activate the adhesive dispensing system 21. In accordance with this embodiment, the timing system 100 sends an adhesive dispensing signal to the adhesive dispensing system 21 when the timing system 100 receives the first distance measurement signal from the distance measurement system 3 to cause the adhesive dispensing system 21 to dispense adhesive material onto the road surface at a preselected location on the road surface. In accordance with this embodiment, the timing system 100 delays sending the engagement signal to the engaging mechanism 14 by a predetermined time delay after sending the adhesive dispensing signal to the adhesive dispensing system 21. The predetermined time delay is chosen to ensure that the road marker lands in the adhesive material disposed at the preselected location on the road surface. A calibration process is typically performed to determine the proper length of the predetermined time delay, although the calibration process is not required to be performed in all embodiments.

It should be noted that although the systems 1 and 50 shown in FIGS. 1 and 7, respectively, have been described with reference to dispensing road markers such as road markers 19 and 62 shown in FIGS. 4 and 9, respectively, the systems 1 and 50 may be used to dispense any type of device. The term "road marker," as that term is used herein, should be construed as being any device capable of being dispensed by the systems 1 and 50 shown in FIGS. 1 and 7, respectively.

It should be noted that the inventive principles and concepts have been described with reference to representative embodiments, but that the inventive principles and concepts are not limited to the representative embodiments described herein. Although the inventive principles and concepts have been illustrated and described in detail in the drawings and in the foregoing description, such illustration and description are to be considered illustrative or exemplary and not restrictive; the invention is not limited to the disclosed embodiments. Other variations to the disclosed embodiments can be understood and effected by those skilled in the art, from a study of the drawings, the disclosure, and the appended claims.

What is claimed is:

1. A road marker placement system for dispensing road markers and attaching the road markers to a road surface as the road marker placement system moves along the road surface, the system comprising:

a frame configured to be attached to a vehicle and pulled by the vehicle;

a holder mechanically coupled to the frame and adapted to hold a plurality of road markers, the holder having at least first and second openings for, respectively, loading road markers into and dispensing road markers from the holder;

a drive system mechanically coupled to the frame; and a rotatable carrier mechanically coupled to the drive system to allow the rotatable carrier to be rotationally driven by the drive system, the rotatable carrier having at least a first pocket formed therein that receives one of the road markers dispensed from the second opening of the holder when the rotatable carrier is in a first position in which the first pocket is aligned with the second opening, the rotatable carrier being rotated by the drive system in a first direction from the first position to a second position that is facing the road surface such that the road marker held in the first pocket is forced at least by gravity and by centrifugal force of the rotating rotatable carrier to be ejected from the first pocket onto an adhesive material located on the road surface, and wherein after the road marker is ejected from the first pocket, the drive system rotates the rotatable carrier in the first direction from the second position back to the first position where another of the road markers is dispensed from the second opening of the holder into the first pocket; and wherein the drive system is mechanically coupled via an engaging mechanism to the rotatable carrier, the engaging mechanism being linked with the frame such that the forward speed of the frame is translated to the rotatable carrier and the rotatable carrier is rotated at the speed of the frame, thereby ensuring that a speed of the road marker ejected from the rotatable carrier is at or near zero relative to the road surface and that placement of each road marker on the adhesive material is precisely accomplished.

2. A road marker placement system for dispensing road markers and attaching the road markers to a road surface as the road marker placement system moves along the road surface, the system comprising:

a frame configured to be attached to a vehicle and pulled by the vehicle;

a holder mechanically coupled to the frame and adapted to hold a plurality of road markers, the holder having at least first and second openings for, respectively, loading road markers into and dispensing road markers from the holder;

a drive system mechanically coupled to the frame;

a rotatable carrier mechanically coupled to the drive system to allow the rotatable carrier to be rotationally driven by the drive system, the rotatable carrier having at least a first pocket formed therein that receives one of the road markers dispensed from the second opening of the holder when the rotatable carrier is in a first position in which the first pocket is aligned with the second opening, the rotatable carrier being rotated by the drive system in a first direction from the first position to a second position that is facing the road surface such that the road marker held in the first pocket is forced at least by gravity and by centrifugal force of the rotating rotatable carrier to be ejected from the first pocket onto an adhesive material located on the road surface, and wherein after the road marker is ejected from the first pocket, the drive system rotates the rotatable carrier in the first direction from the second position back to the first position where another of the road markers is dispensed from the second opening of the holder into the first pocket; and a shield having an inner surface that is spaced apart from an outer surface of the rotatable carrier by a gap having a preselected gap width, the inner surface having a shape that is substantially complementary in shape to the outer surface of the rotatable carrier, the shield extending approximately from the first position to the second position, the preselected gap width being chosen to allow a road marker seated in the first pocket to pass underneath the inner surface of the shield, the shield ensuring that the road marker seated in the first pocket remains in the first pocket as the rotatable carrier is rotated in the first direction from the first position to the second position.

3. A road marker placement system for dispensing road markers and attaching the road markers to a road surface as the road marker placement system moves along the road surface, the system comprising:

a frame configured to be attached to a vehicle and pulled by the vehicle;

a holder mechanically coupled to the frame and adapted to hold a plurality of road markers, the holder having at least first and second openings for, respectively, loading road markers into and dispensing road markers from the holder;

a drive system mechanically coupled to the frame;

a rotatable carrier mechanically coupled to the drive system to allow the rotatable carrier to be rotationally driven by the drive system, the rotatable carrier having at least a first pocket formed therein that receives one of the road markers dispensed from the second opening of the holder when the rotatable carrier is in a first position in which the first pocket is aligned with the second opening, the rotatable carrier being rotated by the drive system in a first direction from the first position to a second position that is facing the road surface such that the road marker held in the first pocket is forced at least by gravity and by centrifugal force of the rotating rotatable carrier to be ejected from the first pocket onto an adhesive material located on the road surface, and wherein after the road marker is ejected from the first pocket, the drive system rotates the rotatable carrier in the first direction from the second position back to the first position where another of the road markers is dispensed from the second opening of the holder into the first pocket; and an engaging mechanism mechanically coupled to the frame and configured to engage the drive system with the rotatable carrier when an engagement signal is received by the engaging mechanism to cause the rotatable carrier to rotate in the first rotational direction from the first position to the second position and back to the first position;

a distance measurement system mechanically coupled to the frame, the distance measurement system measuring distance traveled by the road marker placement system and generating a first distance signal when the road marker placement system has traveled a first predetermined distance; and a timing system in communication with the distance measurement system for receiving the first distance signal from the distance measurement system, wherein after the timing system receives the first distance signal, the timing system sends the engagement signal to the engaging mechanism to cause the engaging mechanism to engage the drive system with the rotatable carrier to cause the rotatable carrier to be rotated by the drive system from the first position at which the road marker is received in the first pocket, to the second position at which the road marker seated in the pocket is ejected from the first pocket onto the adhesive material, and back to the first position where another of the road markers is dispensed from the second opening of the holder into the first pocket.

4. The road marker placement system of claim 3, wherein the frame comprises an axle and at least a first wheel mechanically coupled to an end of the axle, and wherein the drive system comprises a sprocket-to-chain or a sprocket-to-belt drive that is mechanically coupled to the axle such that rotations of the axle are translated into rotations of the sprocket, the engaging mechanism engaging the sprocket with the rotatable carrier when the engagement signal is received by the engaging mechanism to cause the rotatable carrier to rotate in the first rotational direction from the first position to the second position and back to the first position, the distance measurement system also being mechanically coupled to the axle, the distance measurement system measuring the distance traveled by the road marker placement system and generating the first distance signal based at least in part on rotations of the axle.

5. The road marker placement system of claim 3, wherein the drive system comprises a hydraulic drive that rotationally drives the rotatable carrier when the engagement mechanism engages the drive system with the rotatable carrier.

6. The road marker placement system of claim 3, wherein the drive system comprises an electric drive that rotationally drives the rotatable carrier when the engagement mechanism engages the drive system with the rotatable carrier.

7. The road marker placement system of claim 3, further comprising:

an adhesive dispensing system in communication with the timing system, the timing system sending an adhesive dispensing signal to the adhesive dispensing system after the timing system receives the first distance signal to cause the adhesive dispensing system to dispense adhesive material onto the road surface to form the adhesive material on the road surface, and wherein the timing system delays sending the engagement signal to the engaging mechanism by a predetermined time delay after sending the adhesive dispensing signal to the adhesive dispensing system.

8. The road marker placement system of claim 7, wherein the adhesive dispensing system dispenses adhesive material onto the road surface to form the adhesive material without halting forward movement of the road marker placement system.

9. The road marker placement system of claim 3, wherein the engaging mechanism includes a wrap spring clutch that is actuated when the engaging mechanism receives the engagement signal, wherein engagement of the wrap spring clutch engages the drive system with the rotatable carrier.

10. The road marker system of claim 2, wherein the rotatable carrier is rotated in a continuous motion from the first position to the second position and back to the first position, and wherein each time the rotatable carrier is rotated back to the first position, a next road marker held at a lowest location in the holder is dispensed from the second opening of the holder into the first pocket of the rotatable carrier, and wherein each time the rotatable carrier is rotated from the first position back to the second position, the road marker seated in the first pocket is ejected from the first pocket onto adhesive material located on the road surface.

11. The road marker system of claim 2, wherein the rotatable carrier halts rotational motion when the rotatable carrier is rotated back to the first position where a next road marker held at a lowest location in the holder is dispensed from the second opening of the holder into the first pocket of the rotatable carrier, and wherein the rotational motion of the rotatable carrier remains halted until the engaging mechanism receives the engaging signal from the timing system, thereby causing the engaging mechanism to re-engage the drive system with the rotatable carrier.

12. A method of using a road marker placement system for dispensing road markers and attaching the road markers to a road surface as the road marker placement system moves along the road surface, the method comprising:

with a holder of the road marker placement system that is mechanically coupled to a frame of the road marker placement system, holding a plurality of road markers, the holder having at least first and second openings for, respectively, loading road markers into and dispensing road markers from the holder; and with a drive system of the road marker placement system, rotationally driving a rotatable carrier of the road marker placement system, the rotatable carrier having at least a first pocket formed therein that receives one of the road markers dispensed from the second opening of the holder when the rotatable carrier is in a first position in which the first pocket is aligned with the second opening of the holder, the rotatable carrier being rotated by the drive system in a first direction from the first position to a second position that is facing the road surface such that the road marker held in the first pocket is forced at least by gravity and by centrifugal force of the rotating rotatable carrier to be ejected from the first pocket onto an adhesive material located on the road surface, and wherein after the road marker is ejected from the first pocket, the drive system rotates the rotatable carrier in the first direction from the second position back to the first position where another of the road markers is dispensed from the second opening of the holder into the first pocket; and with the drive system of the road marker placement system, rotationally driving the rotatable carrier so that the road marker is ejected at a speed from the rotatable carrier at or near zero relative to the road surface and so that placement of the road marker on the adhesive material is precisely accomplished.

13. A method of using a road marker placement system for dispensing road markers and attaching the road markers to a road surface as the road marker placement system moves along the road surface, the method comprising:

with a holder of the road marker placement system that is mechanically coupled to a frame of the road marker placement system, holding a plurality of road markers, the holder having at least first and second openings for, respectively, loading road markers into and dispensing road markers from the holder; and with a drive system of the road marker placement system, rotationally driving a rotatable carrier of the road marker placement system, the rotatable carrier having at least a first pocket formed therein that receives one of the road markers dispensed from the second opening of the holder when the rotatable carrier is in a first position in which the first pocket is aligned with the second opening of the holder, the rotatable carrier being rotated by the drive system in a first direction from the first position to a second position that is facing the road surface such that the road marker held in the first pocket is forced at least by gravity and by centrifugal force of the rotating rotatable carrier to be ejected from the first pocket onto an adhesive material located on the road surface, and wherein after the road marker is ejected from the first pocket, the drive system rotates the rotatable carrier in the first direction from the second position back to the first position where another of the road markers is dispensed from the second opening of the holder into the first pocket; and with a distance measurement system of the road marker placement system, measuring distance traveled by the road marker placement system and generating a first distance signal when the road marker placement system has traveled a first predetermined distance; and with a timing system in communication with the distance measurement system, receiving the first distance signal from the distance measurement system;

with the timing system, after receiving the first distance signal, sending an engagement signal to an engaging mechanism of the road marker placement to cause the engaging mechanism to engage the drive system with the rotatable carrier to cause the rotatable carrier to be rotated by the drive system from the first position at which the road marker is received in the first pocket, to the second position at which the road marker seated in the pocket is ejected from the first pocket onto the adhesive material, and back to the first position where another of the road markers is dispensed from the second opening of the holder into the first pocket.

14. The method of claim 13, wherein the frame comprises an axle and at least a first wheel mechanically coupled to an end of the axle, and wherein the drive system comprises a sprocket-to-chain or a sprocket-to-belt drive that is mechanically coupled to the axle such that rotations of the axle are translated into rotations of the sprocket, the engaging mechanism engaging the sprocket with the rotatable carrier when the engagement signal is received by the engaging mechanism from the timing system to cause the rotatable carrier to rotate in the first rotational direction from the first position to the second position and back to the first position, the distance measurement system also being mechanically coupled to the axle, the distance measurement system measuring the distance traveled by the road marker placement system and generating the first distance signal based at least in part on rotations of the axle.

15. The method of claim 13, wherein the drive system comprises a hydraulic drive that rotationally drives the rotatable carrier when the engagement mechanism engages the drive system with the rotatable carrier.

16. The method of claim 13, wherein the drive system comprises an electric drive that rotationally drives the rotatable carrier when the engagement mechanism engages the drive system with the rotatable carrier.

17. The method of claim 13, further comprising:

with an adhesive dispensing system in communication with the timing system, receiving an adhesive dispensing signal from the timing system after the timing system receives the first distance signal and causing the adhesive dispensing system to dispense adhesive material onto the road surface to form the adhesive material on the road surface, and wherein the timing system delays sending the engagement signal to the engaging mechanism by a predetermined time delay after sending the adhesive dispensing signal to the adhesive dispensing system.

18. The method of claim 17, wherein the adhesive dispensing system dispenses adhesive material onto the road surface to form the adhesive material without halting forward movement of the road marker placement system.

19. The method of claim 13, wherein the engaging mechanism includes a wrap spring clutch that is actuated when the engaging mechanism receives the engagement signal, wherein engagement of the wrap spring clutch engages the drive system with the rotatable carrier.

20. The method of claim 13, wherein the rotatable carrier is rotated in a continuous motion from the first position to the second position and back to the first position, and wherein each time the rotatable carrier is rotated back to the first position, a next road marker held at a lowest location in the holder is dispensed from the second opening of the holder into the first pocket of the rotatable carrier, and wherein each time the rotatable carrier is rotated from the first position back to the second position, the road marker seated in the first pocket is ejected from the first pocket onto adhesive material located on the road surface.

21. A method of using a road marker placement system for dispensing road markers and attaching the road markers to a road surface as the road marker placement system moves along the road surface, the method comprising:

with a holder of the road marker placement system that is mechanically coupled to a frame of the road marker placement system, holding a plurality of road markers, the holder having at least first and second openings for, respectively, loading road markers into and dispensing road markers from the holder; and with a drive system of the road marker placement system, rotationally driving a rotatable carrier of the road marker placement system, the rotatable carrier having at least a first pocket formed therein that receives one of the road markers dispensed from the second opening of the holder when the rotatable carrier is in a first position in which the first pocket is aligned with the second opening of the holder, the rotatable carrier being rotated by the drive system in a first direction from the first position to a second position that is facing the road surface such that the road marker held in the first pocket is forced at least by gravity and by centrifugal force of the rotating rotatable carrier to be ejected from the first pocket onto an adhesive material located on the road surface, and wherein after the road marker is ejected from the first pocket, the drive system rotates the rotatable carrier in the first direction from the second position back to the first position where another of the road markers is dispensed from the second opening of the holder into the first pocket; and wherein the rotatable carrier halts rotational motion when the rotatable carrier is rotated back to the first position where a next road marker held at a lowest location in the holder is dispensed from the second opening of the holder into the first pocket of the rotatable carrier, and wherein the rotational motion of the rotatable carrier remains halted until the engaging mechanism receives the engaging signal from the timing system, thereby causing the engaging mechanism to re-engage the drive system with the rotatable carrier.

22. A road marker placement system for dispensing road markers and attaching the road markers to a road surface as the road marker placement system moves along the road surface, the system comprising:

a frame configured to be attached to a vehicle and pulled by the vehicle;

a holder mechanically coupled to the frame and adapted to hold a plurality of road markers, the holder having at least first and second openings for, respectively, loading road markers into and dispensing road markers from the holder;

a drive system mechanically coupled to the frame; and a rotatable carrier mechanically coupled to the drive system to allow the rotatable carrier to be rotationally driven by the drive system, the rotatable carrier having at least a first pocket formed therein that receives one of the road markers dispensed from the second opening of the holder when the rotatable carrier is in a first position in which the first pocket is aligned with the second opening, the rotatable carrier being rotated by the drive system in a first direction from the first position to a second position that is facing the road surface such that the road marker held in the first pocket is forced at least by gravity and by centrifugal force of the rotating rotatable carrier to be ejected from the first pocket onto an adhesive material located on the road surface, and wherein after the road marker is ejected from the first pocket, the drive system rotates the rotatable carrier in the first direction from the second position back to the first position where another of the road markers is dispensed from the second opening of the holder into the first pocket; and wherein the drive system rotationally drives the rotatable carrier so that the road marker is ejected at a speed from the rotatable carrier at or near zero relative to the road surface, resulting in precise placement of the road marker on the adhesive material.

23. The road marker placement system of claim 22, further comprising:

a shield having an inner surface that is spaced apart from an outer surface of the rotatable carrier by a gap having a preselected gap width, the inner surface having a shape that is substantially complementary in shape to the outer surface of the rotatable carrier, the shield extending approximately from the first position to the second position, the preselected gap width being chosen to allow a road marker seated in the first pocket to pass underneath the inner surface of the shield, the shield ensuring that the road marker seated in the first pocket remains in the first pocket as the rotatable carrier is rotated in the first direction from the first position to the second position.

24. The road marker placement system of claim 22, further comprising:

an engaging mechanism mechanically coupled to the frame and configured to engage the drive system with the rotatable carrier when an engagement signal is received by the engaging mechanism to cause the rotatable carrier to rotate in the first rotational direction from the first position to the second position and back to the first position;

a distance measurement system mechanically coupled to the frame, the distance measurement system measuring distance traveled by the road marker placement system and generating a first distance signal when the road marker placement system has traveled a first predetermined distance; and a timing system in communication with the distance measurement system for receiving the first distance signal from the distance measurement system, wherein after the timing system receives the first distance signal, the timing system sends the engagement signal to the engaging mechanism to cause the engaging mechanism to engage the drive system with the rotatable carrier to cause the rotatable carrier to be rotated by the drive system from the first position at which the road marker is received in the first pocket, to the second position at which the road marker seated in the pocket is ejected from the first pocket onto the adhesive material, and back to the first position where another of the road markers is dispensed from the second opening of the holder into the first pocket.

25. The road marker placement system of claim 24, wherein the frame comprises an axle and at least a first wheel mechanically coupled to an end of the axle, and wherein the drive system comprises a sprocket-to-chain or a sprocket-to-belt drive that is mechanically coupled to the axle such that rotations of the axle are translated into rotations of the sprocket, the engaging mechanism engaging the sprocket with the rotatable carrier when the engagement signal is received by the engaging mechanism to cause the rotatable carrier to rotate in the first rotational direction from the first position to the second position and back to the first position, the distance measurement system also being mechanically coupled to the axle, the distance measurement system measuring the distance traveled by the road marker placement system and generating the first distance signal based at least in part on rotations of the axle.

26. The road marker placement system of claim 24, wherein the drive system comprises a hydraulic drive that rotationally drives the rotatable carrier when the engagement mechanism engages the drive system with the rotatable carrier.

27. The road marker placement system of claim 24, wherein the drive system comprises an electric drive that rotationally drives the rotatable carrier when the engagement mechanism engages the drive system with the rotatable carrier.

28. The road marker placement system of claim 24, further comprising:

an adhesive dispensing system in communication with the timing system, the timing system sending an adhesive dispensing signal to the adhesive dispensing system after the timing system receives the first distance signal to cause the adhesive dispensing system to dispense adhesive material onto the road surface to form the adhesive material on the road surface, and wherein the timing system delays sending the engagement signal to the engaging mechanism by a predetermined time delay after sending the adhesive dispensing signal to the adhesive dispensing system.

29. The road marker placement system of claim 28, wherein the adhesive dispensing system dispenses adhesive material onto the road surface to form the adhesive material without halting forward movement of the road marker placement system.

30. The road marker placement system of claim 24, wherein the engaging mechanism includes a wrap spring clutch that is actuated when the engaging mechanism receives the engagement signal, wherein engagement of the wrap spring clutch engages the drive system with the rotatable carrier.

31. The road marker system of claim 24, wherein the rotatable carrier is rotated in a continuous motion from the first position to the second position and back to the first position, and wherein each time the rotatable carrier is rotated back to the first position, a next road marker held at a lowest location in the holder is dispensed from the second opening of the holder into the first pocket of the rotatable carrier, and wherein each time the rotatable carrier is rotated from the first position back to the second position, the road marker seated in the first pocket is ejected from the first pocket onto adhesive material located on the road surface.

32. The road marker system of claim 24, wherein the rotatable carrier halts rotational motion when the rotatable carrier is rotated back to the first position where a next road marker held at a lowest location in the holder is dispensed from the second opening of the holder into the first pocket of the rotatable carrier, and wherein the rotational motion of the rotatable carrier remains halted until the engaging mechanism receives the engaging signal from the timing system, thereby causing the engaging mechanism to re-engage the drive system with the rotatable carrier.

* * * * *